US008011763B2

(12) United States Patent
Ito

(10) Patent No.: US 8,011,763 B2
(45) Date of Patent: Sep. 6, 2011

(54) DROPLET EJECTING APPARATUS

(75) Inventor: Atsushi Ito, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 877 days.

(21) Appl. No.: 12/011,371

(22) Filed: Jan. 25, 2008

(65) Prior Publication Data

US 2008/0180492 A1 Jul. 31, 2008

(30) Foreign Application Priority Data

Jan. 30, 2007 (JP) ..... 2007-019285

(51) Int. Cl.
*B41J 2/045* (2006.01)

(52) U.S. Cl. ..... 347/71; 347/72

(58) Field of Classification Search ..... 347/71, 347/72

See application file for complete search history.

(56) References Cited

U.S. PATENT DOCUMENTS

| | | | | |
|---|---|---|---|---|
| 5,548,314 | A * | 8/1996 | Okazawa et al. | 347/71 |
| 6,036,303 | A * | 3/2000 | Yamamoto et al. | 347/70 |
| 6,168,255 | B1 * | 1/2001 | Nagashima | 347/20 |
| 6,626,524 | B2 * | 9/2003 | Okazawa et al. | 347/68 |
| 2004/0263580 | A1 * | 12/2004 | Shimizu et al. | 347/68 |
| 2005/0122380 | A1 | 6/2005 | Nakamura et al. | |
| 2006/0066675 | A1 * | 3/2006 | Ito et al. | 347/50 |
| 2006/0176338 | A1 * | 8/2006 | Deguchi et al. | 347/43 |
| 2007/0182787 | A1 * | 8/2007 | Kubo et al. | 347/50 |

FOREIGN PATENT DOCUMENTS

| | | |
|---|---|---|
| JP | 3079688 | 8/2000 |
| JP | 2004142296 | 5/2004 |
| JP | 3243865 | 1/2005 |
| JP | 2005-161761 | 6/2005 |

* cited by examiner

*Primary Examiner* — Charlie Peng
(74) *Attorney, Agent, or Firm* — Frommer Lawrence & Haug LLP

(57) ABSTRACT

A droplet ejecting apparatus, including: a head unit having a generally planar shape and including nozzles through which droplets are ejected, a holder holding the head unit, a reinforcing plate via which the head unit is held by the holder and which has an adhesion surface as at least a part of one of opposite surfaces thereof to which an adhesion surface of the head unit as at least a part of one of opposite surfaces thereof is adhered with an adhesive layer interposed between the adhesion surfaces, and an adhesion portion constituted by the adhesion surfaces and the adhesive layer, wherein the adhesion portion has a special region in which (a) first sections in each of which respective parts of the adhesion surfaces are opposed to each other with a part of the adhesive layer interposed therebetween and are adhered to each other and (b) second sections in each of which a part of the adhesion surface of one of the head unit and the reinforcing plate is opposed to a space and is not adhered to the adhesion surface of the other are alternately arranged.

25 Claims, 11 Drawing Sheets

DROPLET EJECTING APPARATUS

CROSS REFERENCE TO RELATED APPLICATION

The present application claims priority from Japanese Patent Application No. 2007-019285, which was filed on Jan. 30, 2007, the disclosure of which is herein incorporated by reference in its entirety.

BACKGROUND OF THE INVENTION

1. Field of the Invention

The present invention relates to a droplet ejecting apparatus including a head unit which ejects droplets by driving of an actuator. In particular, the present invention is suitable for a droplet ejecting apparatus in which the head unit is mounted on a head holder via a reinforcing plate.

2. Description of the Related Art

There is conventionally known an ink-jet recording apparatus, as a droplet ejecting apparatus of the above-described type, in which a recording operation is performed on a recording medium with ink droplets ejected by a head unit that is reciprocated while being opposed to the recording medium. The head unit is attached to a reinforcing plate as disclosed by Japanese Patent Application No. 2005-161761, and is mounted as a unit with the reinforcing plate on a head holder. FIG. 11 is an explanatory view of the head unit and the reinforcing plate provided on the conventional ink-jet recording apparatus described above.

The head unit 30 includes a cavity unit 50 in which ink flow channels are formed, and a piezoelectric actuator 40 bonded to an upper surface of the cavity unit 50. Ink supply holes 31*a*, 31*b*, 31*c*, 31*d* for supplying inks to the ink flow channels are formed in the head unit 30. In a lower surface of the head unit 30, there are arranged a plurality of nozzle rows in each of which a plurality of nozzles that eject ink droplets are arranged. The cavity unit 50 is constituted by eight plate members stacked on each other. The plate members are adhered to each other with an adhesive (not shown).

The head unit 30 is fixed to the head holder (indicated at "9" in FIG. 3) via the reinforcing plate 60. The reinforcing plate 60 is wider than the head unit 30. The reinforcing plate 60 has an opening 60*e* for exposing the piezoelectric actuator 40 in a state in which the reinforcing plate 60 is adhered to the head unit 30. Reference numerals 60*a*, 60*b*, 60*c*, 60*d* indicate ink supply holes for supplying the inks to the respective ink supply holes 31*a*-31*d* of the head unit 30. The reinforcing plate 60 is adhered to the head unit 30 with a thermoplastic adhesive sheet 2. The adhesive sheet 2 has a plan-view shape corresponding to that of the cavity unit 50.

A high strength of adhesion is required when the reinforcing plate 60 is adhered to the head unit 30 with the adhesive sheet 2. Thus, a heavy load and enough heat are given between the reinforcing plate 60 and the head unit 30. As a result, the adhesive sheet 2 interposed between the reinforcing plate 60 and the head unit 30 is pressed and thinned, which leads to the high strength of adhesion and enhancement of a rigidity of the head unit 30.

SUMMARY OF THE INVENTION

However, an examination conducted by the present inventor has showed that vibrations generated upon driving of the actuator cannot be absorbed by an entirety of the reinforcing plate 60 and the head unit 30 because of the firm fixation of the reinforcing plate 60 and the head unit 30. The examination has further showed that respective portions of the reinforcing plate 60 and the head unit 30 which are not adhered to each other receive the vibrations, resulting in generation of a cross talk. The cross talk is a phenomenon in which vibrations generated upon ejection are transferred among rows of nozzles and adversely affected to each other in ink-ejection properties of the nozzles.

In view of the above, it is an object of the present invention to provide a droplet ejecting apparatus which can reduce the cross talk among the nozzle rows upon simultaneous ejections of liquids through different rows of the nozzles.

The object indicated above may be achieved according to the present invention which provides a droplet ejecting apparatus, comprising: a head unit having a generally planar shape and including a plurality of nozzles through which droplets are ejected, a holder which holds the head unit, a reinforcing plate via which the head unit is held by the holder and which has an adhesion surface as at least a part of one of opposite surfaces thereof to which an adhesion surface of the head unit as at least a part of one of opposite surfaces thereof is adhered with an adhesive layer interposed between the adhesion surface of the reinforcing plate and the adhesion surface of the head unit, and an adhesion portion constituted by the adhesion surface of the head unit, the adhesion surface of the reinforcing plate, and the adhesive layer, wherein the adhesion portion has a special region in which (a) a plurality of first sections in each of which a part of the adhesion surface of the head unit and a part of the adhesion surface of the reinforcing plate are opposed to each other with a part of the adhesive layer interposed therebetween and are adhered to each other and (b) a plurality of second sections in each of which a part of the adhesion surface of one of the head unit and the reinforcing plate is opposed to a space and is not adhered to the adhesion surface of the other of the head unit and the reinforcing plate are alternately arranged.

In the droplet ejecting apparatus constructed as described above, the plurality of first sections in each of which the part of the adhesion surface of the head unit and the part of the adhesion surface of the reinforcing plate are opposed to each other with the part of the adhesive layer interposed therebetween and are adhered to each other and the plurality of second sections in each of which the part of the adhesion surface of one of the head unit and the reinforcing plate is opposed to the space and is not adhered to the adhesion surface of the other of the head unit and the reinforcing plate are alternately arranged. Thus, a strength of the adhesion of the head unit and the reinforcing plate can be slightly reduced. As a result, a rigidity of the head unit is slightly reduced. Therefore, the vibrations generated upon driving of the actuator can be absorbed not only by the second sections but also by the first sections, which leads to reduced cross talk among rows of the nozzles upon simultaneous ejections of inks through different rows of the nozzles.

BRIEF DESCRIPTION OF THE DRAWINGS

The above and other objects, features, advantages, and technical and industrial significance of the present invention will be better understood by reading the following description of preferred embodiments of the invention, when considered in connection with the accompanying drawings, in which:

FIG. 9A is an explanatory view of the reinforcing plate and the head unit which are adhered and fixed to each other as seen from an upper side of the reinforcing plate, and FIG. 9B is a cross-sectional view, in enlargement, showing the cross section taken along line A-A in FIG. 9A, with a portion of the cross section omitted;

DESCRIPTION OF THE PREFERRED EMBODIMENTS

Hereinafter, there will be explained preferred embodiments of a droplet ejecting apparatus of the present invention that relate to an ink-jet recording apparatus 1.

1. Primary Construction

Figure 1:
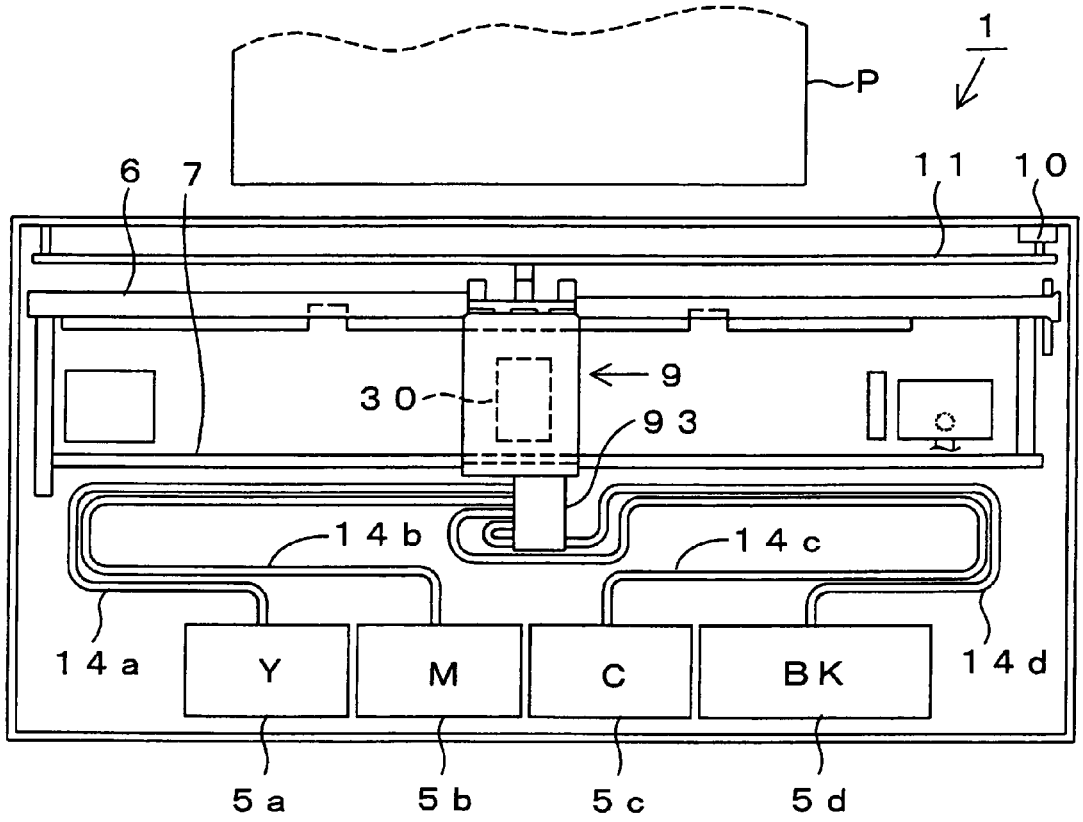
FIG. 1 is an explanatory plan view showing a primary construction of an ink-jet recording apparatus.

Initially, there will be explained a primary construction of the ink-jet recording apparatus 1 with reference to FIG. 1. FIG. 1 is an explanatory plan view showing the primary construction of the ink-jet recording apparatus 1. In the ink-jet recording apparatus 1, two guide rods 6, 7 are provided. A head holder 9 functioning as a carriage is slidably supported on the guide rods 6, 7. The head holder 9 holds a head unit 30 which performs a recording operation by ejecting ink onto a recording sheet P. The head holder 9 is connected to an endless belt 11 which is circulated by a carriage motor 10. This circulation movement of the endless belt 11 moves the head holder 9 along the guide rods 6, 7.

In the ink-jet recording apparatus 1, there are provided ink tanks 5*a*, 5*b*, 5*c*, 5*d*, in each of which a corresponding one of a yellow ink, a magenta ink, a cyan ink, and a black ink is stored. The ink tanks 5*a*-5*d* are respectively connected to flexible ink supply tubes 14*a*, 14*b*, 14*c*, 14*d*. The inks supplied from the respective ink supply tubes 14*a*-14*d* are introduced into the head unit 30 via a tube joint 93 extending frontward from the head holder 9. A pigment ink or a dye ink may be used as each ink.

2. Construction of the Head Unit

Figure 2:
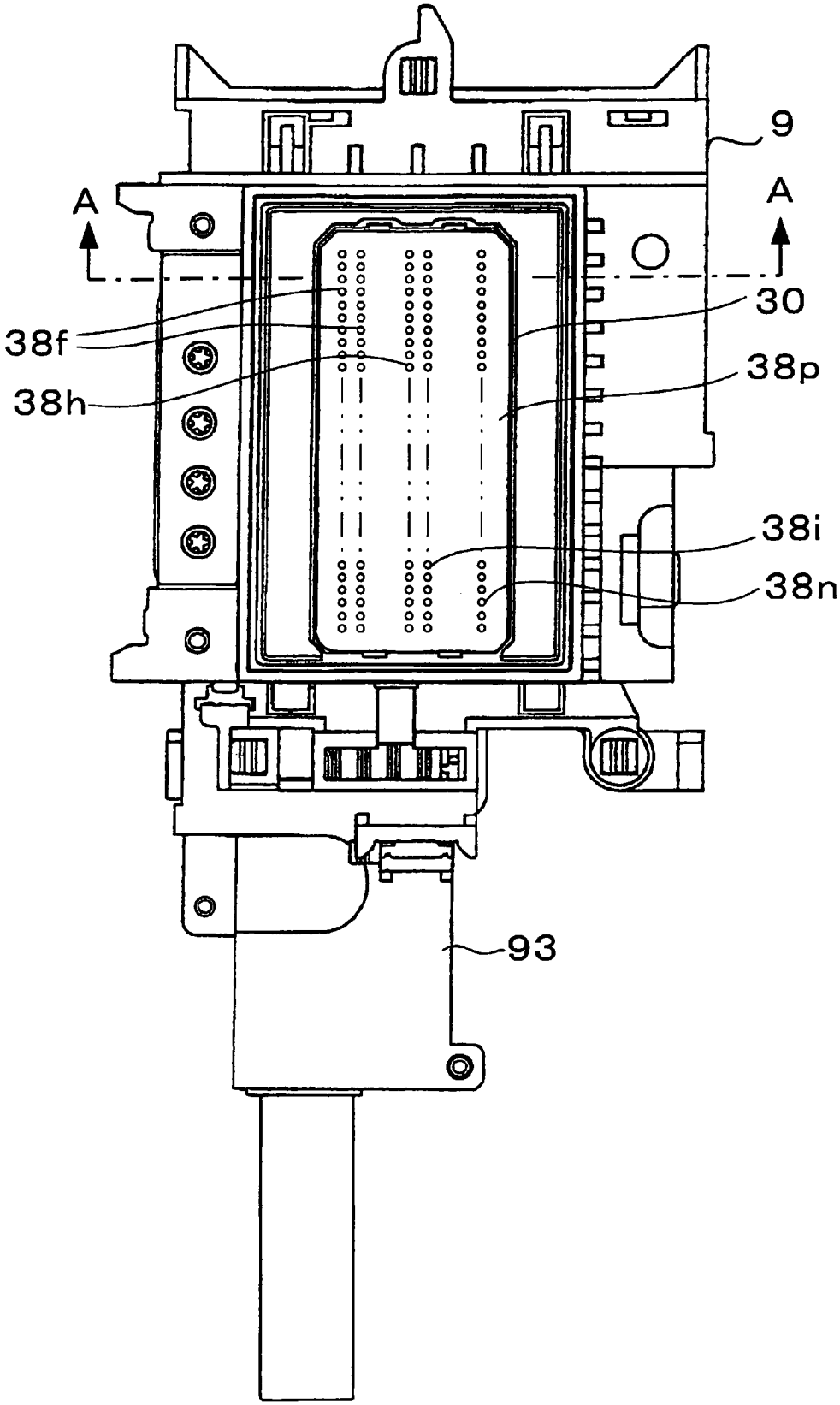
FIG. 2 is a bottom plan view of a head holder as seen from a lower side thereof, showing a nozzle surface as a lower surface of a head unit.
Figure 3:
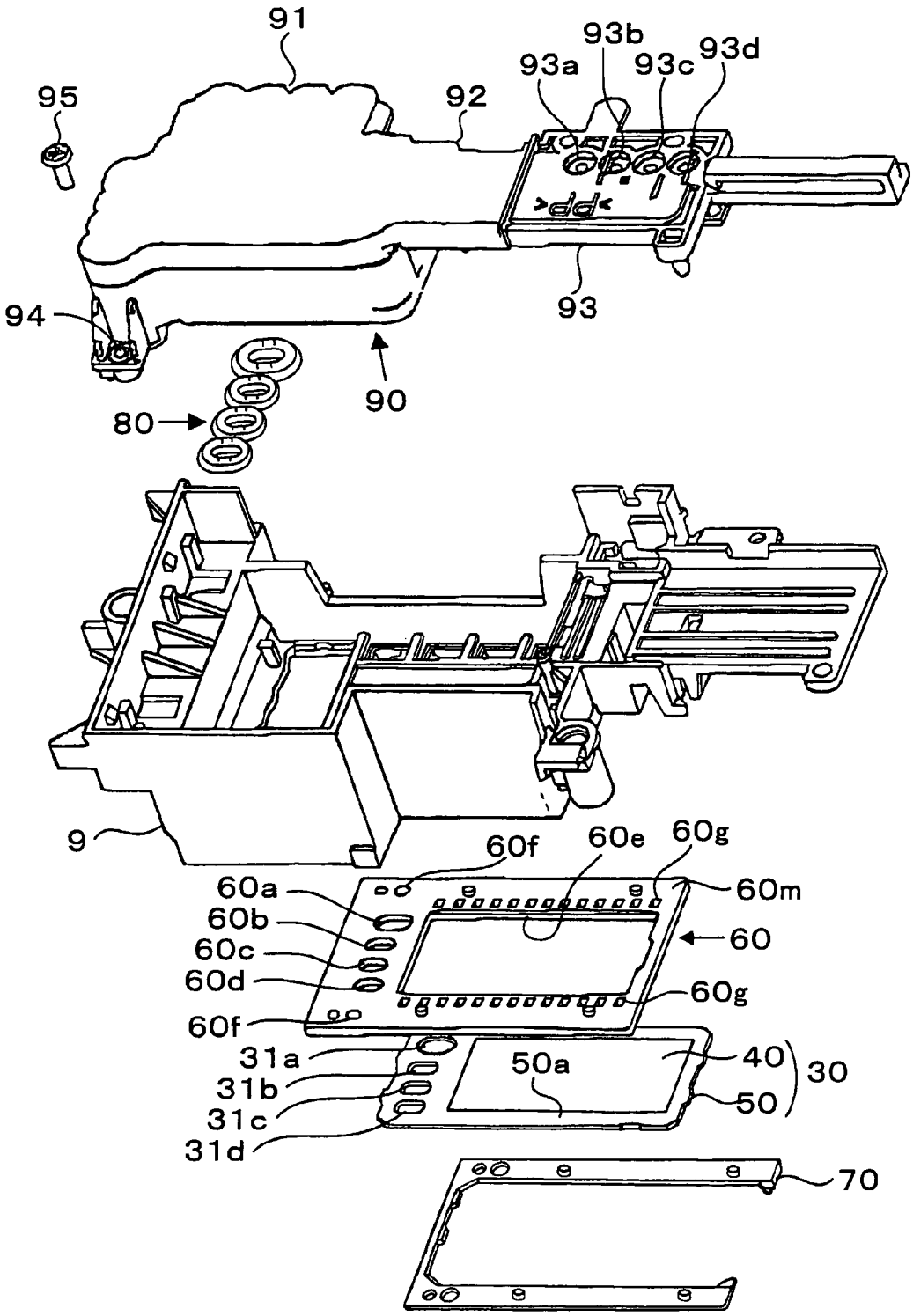
FIG. 3 is an exploded perspective view of the head holder shown in FIG. 2 and parts held by the head holder.
Figure 4:
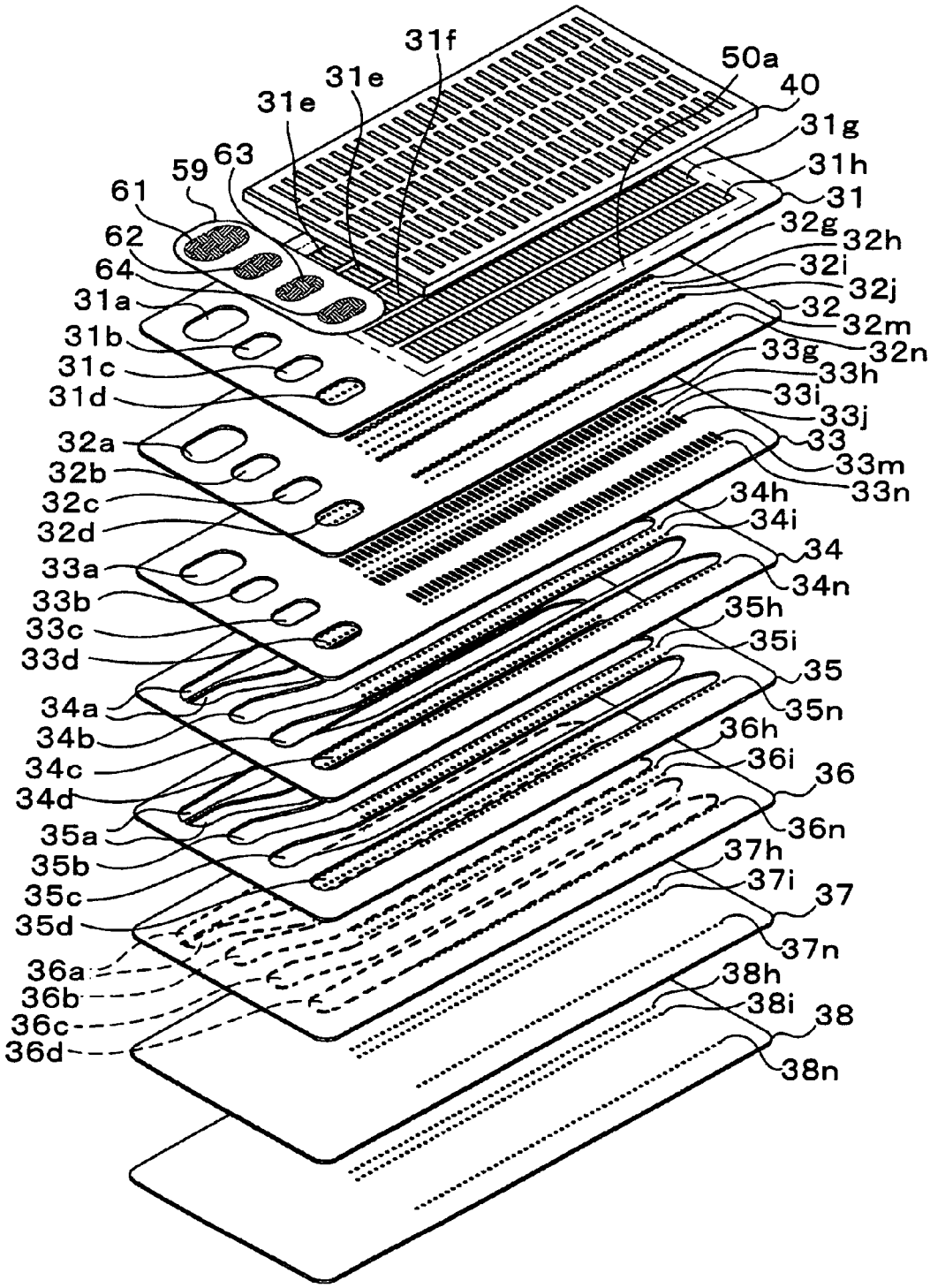
FIG. 4 is a perspective view showing plate members constituting the head unit held by the head holder shown in FIG. 3.
Figure 5:
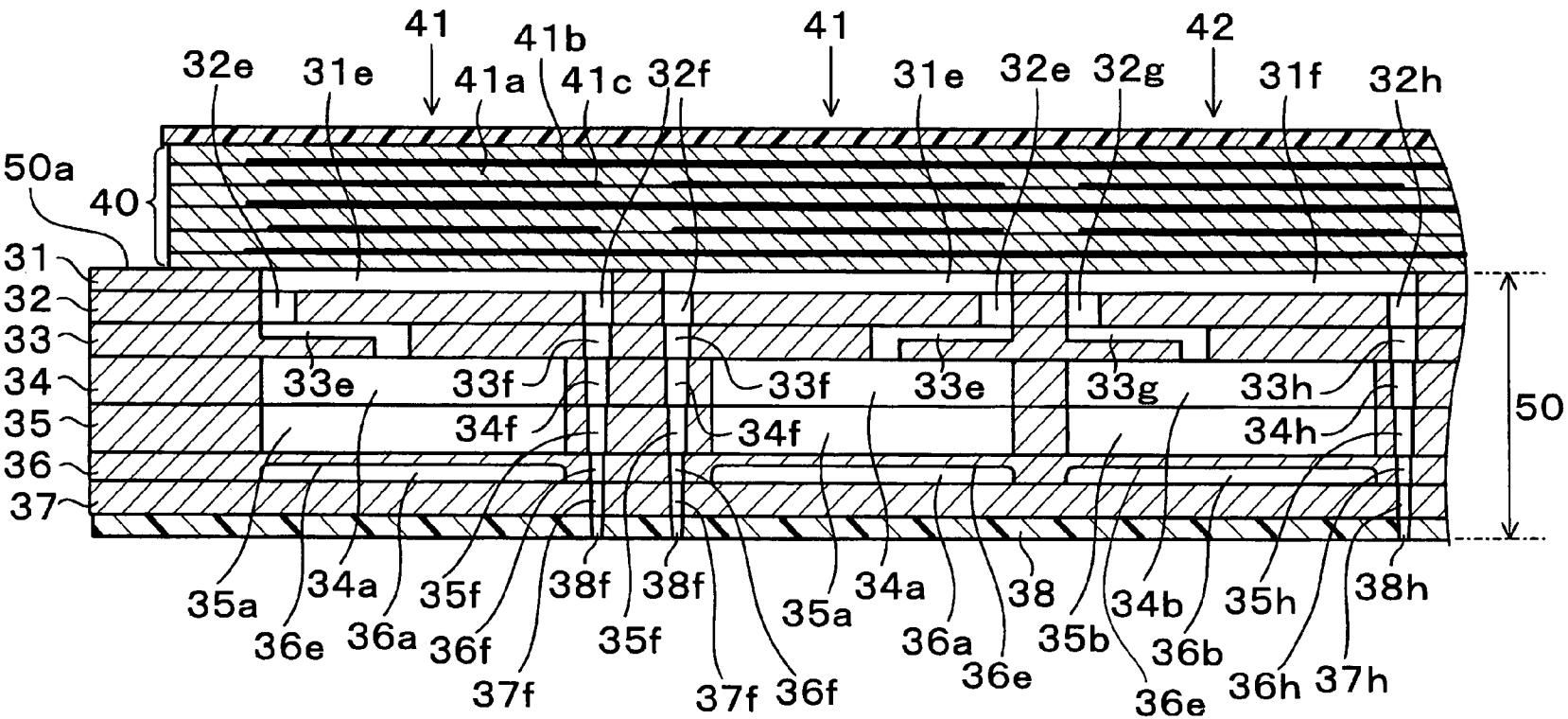
FIG. 5 is an explanatory view showing a cross section of a portion of the head unit held by the head holder shown in FIG. 2, which section is taken along line A-A.
Figure 6:
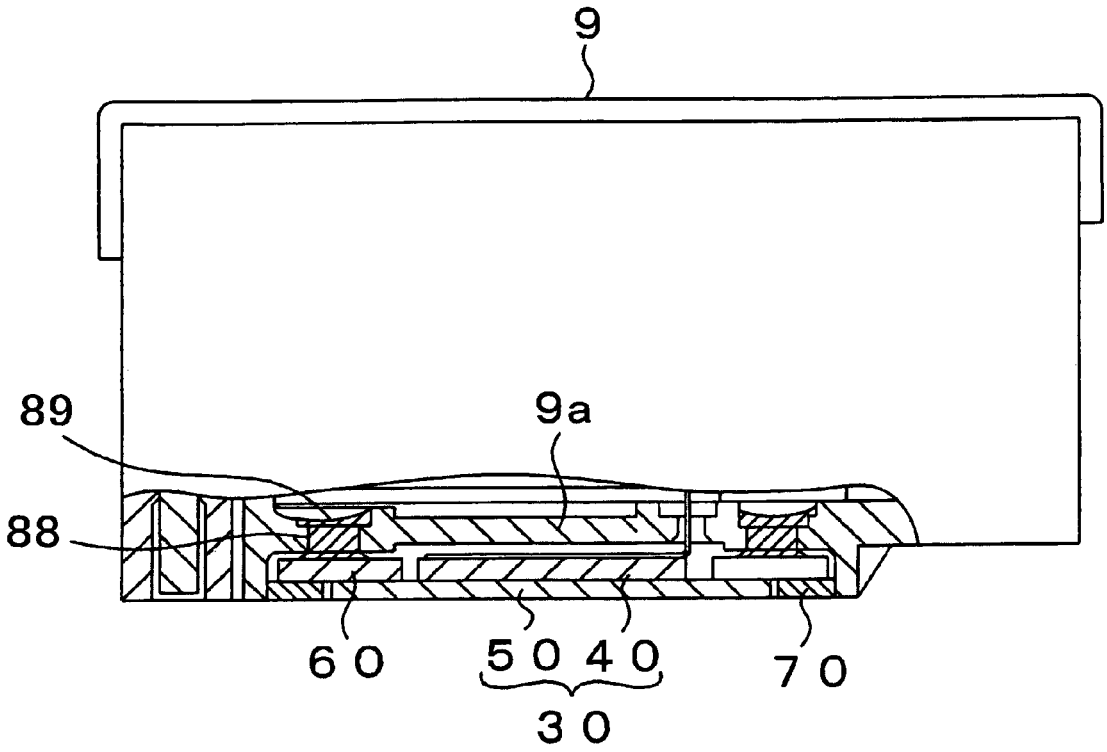
FIG. 6 is a partly cross-sectional view taken along line A-A in FIG. 2.
Figure 11:
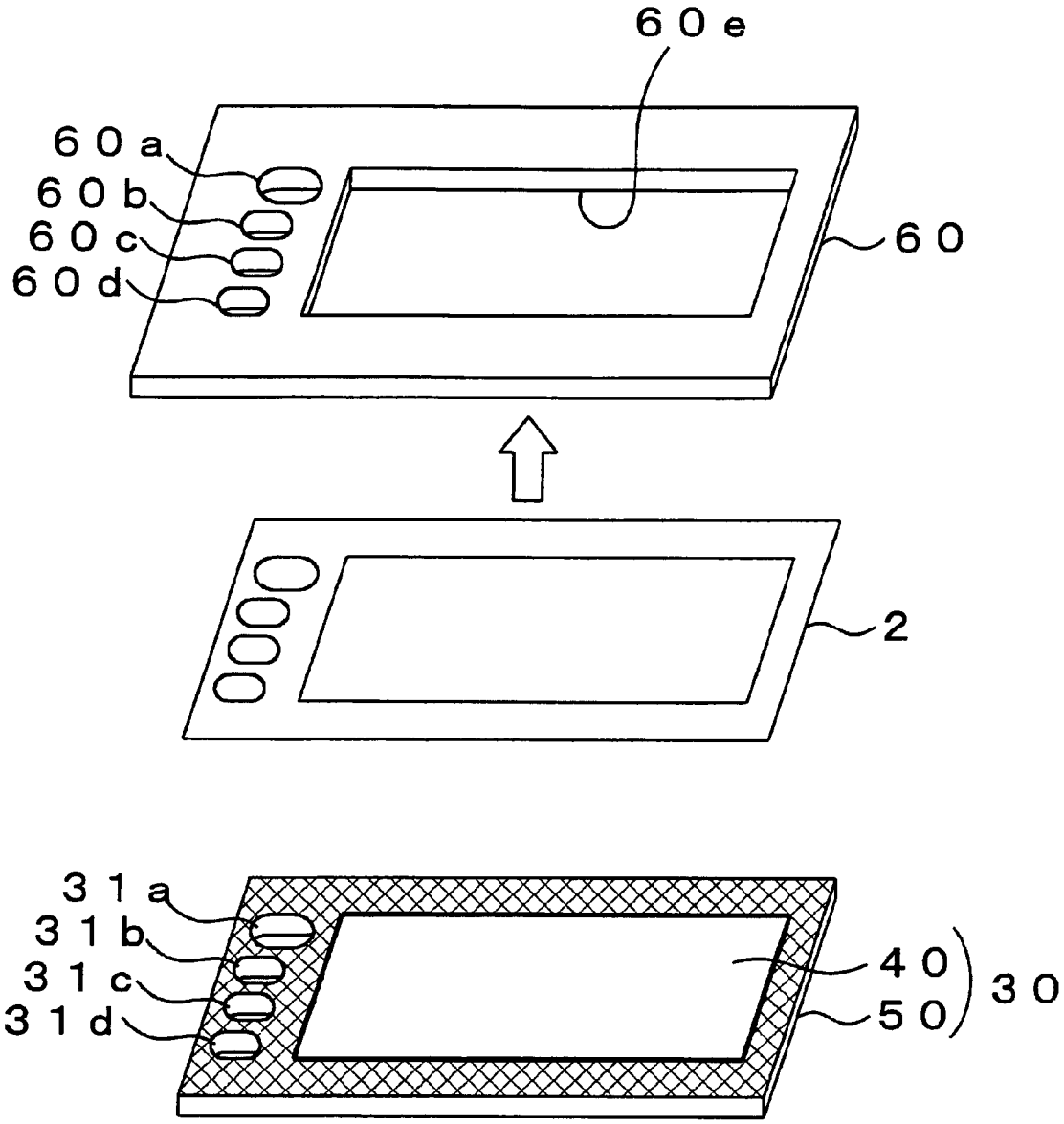
FIG. 11 is an explanatory view of a head unit and a reinforcing plate of a conventional ink-jet recording apparatus.

Next, a construction of the head unit 30 is explained with reference to FIG. 2 through FIG. 5. FIG. 2 is a bottom plan view of the head holder 9 as seen from a lower side thereof, showing a nozzle surface 38*p* as a lower surface of the head unit 30. FIG. 3 is an exploded perspective view of the head holder 9 shown in FIG. 2 and parts held by the head holder 9. FIG. 4 is a perspective view showing plate members constituting the head unit 30 held by the head holder 9 shown in FIG. 3. FIG. 5 is an explanatory view showing a cross-section of a portion of the head unit 30 held by the head holder 9 shown in FIG. 2, which section is taken along line A-A. FIG. 6 is a partly cross-sectional view taken along line A-A in FIG. 2. It is noted that the following description will be explained on the assumption that a downward direction is defined as a direction in which the inks are ejected. In addition, the same reference numerals will be used to designate the corresponding elements or parts of the conventional ink-jet recording apparatus shown in FIG. 11, and the description thereof is omitted.

As shown in FIG. 2, there are provided, in the nozzle surface 38*p*, groups of nozzles 38*f*, 38*h*, 38*i*, 38*n* for respectively ejecting the black ink, the yellow ink, the cyan ink, and the magenta ink. The nozzles of each group are arranged in at least one row so as to extend in a direction perpendicular to a direction in which the head holder 9 is moved (i.e., a main scanning direction). The nozzles 38*f*-38*n* are open downward so as to face an upper surface of the recording sheet P (shown in FIG. 1) as a recording medium.

As shown in FIG. 3, a frame-shaped reinforcing plate 60 is adhered, at a lower surface thereof, to an upper surface of the head unit 30 with an adhesive layer formed of an adhesive sheet (indicated at "2" in FIG. 7) interposed therebetween. A frame 70 is disposed around the head unit 30 and adhered to the lower surface of the reinforcing plate 60 with an adhesive sheet (not shown). The reinforcing plate 60 is fixed to a lower surface of a bottom wall 9*a* of the head holder 9 while supporting the head unit 30. As shown in FIG. 6, this fixation is provided by an adhesive 89 poured through openings 88 formed in the bottom wall 9*a*.

Above the head unit 30, there is disposed a buffer tank 90 for storing the inks to be supplied to the head unit 30. A predetermined amount of air is accumulated in the buffer tank 90. The air reduces impact forces generated when the head unit 30 is moved or stopped. This reduction prevents a fluctuation of pressure in each pressure chamber in the head unit 30, thereby maintaining uniform ink-ejection properties of the nozzles. Where the air separated from each ink exceeds the predetermined amount, it is discharged into the outside by an air-discharge device 91 provided for the buffer tank 90.

An arm portion 92 having ink channels therein is formed in an end portion of the buffer tank 90. In the arm portion 92, there are provided ink intakes 93*a*, 93*b*, 93*c*, 93*d* for respectively taking in the inks supplied from the ink tanks 5*a*-5*d* (shown in FIG. 1) through the tubes 14*a*-14*d*. In a lower surface of the buffer tank 90, there are provided ink supply outlets (not shown) corresponding to the respective inks and formed for supplying the inks from the buffer tank 90 to the head unit 30. A rubber bushing 80 is provided between the ink supply outlets and ink supply holes 60*a*, 60*b*, 60*c*, 60*d* of the reinforcing plate 60. This assures a fluid-tightness between the buffer tank 90 and the reinforcing plate 60.

Two insertion holes 94 are formed in opposite side portions of the buffer tank 90. More specifically, one of the insertion holes 94 shown in FIG. 3 is formed in one of the side portions, and the other insertion hole 94, not shown, is formed in the other side portion. Mounting screws 95 inserted in the respective insertion holes 94 are screwed in respective screw holes 60*f* formed in the reinforcing plate 60. Thus, the buffer tank 90 is fixed to the reinforcing plate 60.

As shown in FIG. 5, the head unit 30 has a planar shape and a construction in which a piezoelectric actuator 40 having a rectangular planar shape is bonded to an upper surface of a cavity unit 50. As shown in FIG. 4, the cavity unit 50 has a laminar structure in which the following eight plate members are stacked on and adhered to each other in the order from the bottom: a nozzle plate 38; a spacer plate 37; a damper plate 36; manifold plates 35, 34; a supply plate 33; a base plate 32; and a cavity plate 31. Each of the plates 31-38 is a thin plate member. The plates 31-38 are adhered to each other with an adhesive (not shown).

In the present embodiment, the adhesive is formed of a thermosetting epoxy resin, for instance. The nozzle plate 38 is made of a synthetic resin such as a polyimide. Each of the other plates 31-37 is made of a metal such as a 42 alloy steel (i.e., a 42%-nickel alloy steel) or a stainless steel.

As shown in FIG. 5, the piezoelectric actuator 40 includes active portions 41, 42, and the like. The active portions 41 generate energy for ejecting the black ink, and the active portions 42 generate energy for ejecting the yellow ink. Although omitted in FIG. 5, there are arranged active portions for generating energy for ejecting the cyan ink, on a right side of the active portions 42. Further, on a right side of the active portions for the cyan ink, there are arranged active portions for generating energy for ejecting the magenta ink. It is noted that the active portions of the piezoelectric actuator 40 are for applying pressure to the inks stored in the respective pressure chambers so as to eject the inks.

The piezoelectric actuator 40 has a construction in which piezoelectric sheets (made of a piezoelectric material) and film-like electrodes are alternately stacked on each other. The active portions 41 are provided by sandwiched portions 41*a* of the piezoelectric sheets each of which is vertically sandwiched between electrodes 41*b* and 41*c*. The other active portions are provided like the active portions 41. The pressure chambers are formed in the cavity plate 31 and below the respective active portions. That is, pressure chambers 31*e* for applying the ejection pressure to the black ink are formed and arranged in the cavity plate 31 and below the respective active portions 41. Similarly, pressure chambers 31*f* for the yellow ink are formed and arranged below the respective active portions 42. The pressure chambers 31*g* (shown in FIG. 4) for the cyan ink and the pressure chambers 31*h* (shown in FIG. 4) for the magenta ink are formed and arranged in respective rows below the other active portions, respectively. In view of the above, the cavity plate 31 can be referred to as a pressure-chamber-defining plate which defines the pressure chambers that store inks to be ejected through the respective nozzles.

Common ink chambers for supplying the inks to the respective pressure chambers are formed below the rows of the pressure chambers. The common ink chambers are formed in the manifold plates 35, 34 and extend over the entire length of the rows of the pressure chambers. More specifically, common chambers 35*a*, 34*a* for storing the black ink are formed in the manifold plates 35, 34 and below the rows of the pressure chambers 31*e*. Common chambers 35*b*, 34*b* for storing the yellow ink are formed in the manifold plates 35, 34 and below the row of the pressure chambers 31*f*. Common chambers 35*c*, 34*c* (shown in FIG. 4) for storing the cyan ink are formed in the manifold plates 35, 34 and below the row of the pressure chambers 31*g*. Common chambers 35*d*, 34*d* (shown in FIG. 4) for storing the magenta ink are formed in the manifold plates 35, 34 and below the row of the pressure chambers 31*h*.

The supply plate 33 is disposed over the common ink chambers 34*a*, 34*b*, 34*c*, 34*d*. The supply plate 33 has restrictor portions 33*e*, 33*g*, 33*j*, 33*m* formed therein in correspondence with the respective pressure chambers. The restrictor portions, each having a recessed shape, are formed in a flat upper surface of the supply plate 33. Each of the restrictor portions communicates, at one of opposite end portions thereof from which the ink flows in, with a corresponding one of the common ink chambers via a corresponding one of communication holes vertically formed through the supply plate 33. The base plate 32 is superposed on the supply plate 33 and covers respective openings of the restrictor portions, each of which extends in its longitudinal direction. Communication holes 32*e*, 32*g*, 32*j*, 32*m* are vertically formed through the base plate 32. Each of the restrictor portions communicates, at the other of opposite end portions thereof from which the ink flows out, with a corresponding one of the pressure chambers via a corresponding one of the communication holes.

Each restrictor portion has a smaller vertical cross-sectional area than the corresponding pressure chamber. Thus, resistance against ink flow is larger in the restrictor portions than in the common ink chambers and the pressure chambers. That is, the restrictor portions function to reduce components of pressure fluctuations toward the common ink chambers, which pressure fluctuations are generated in the pressure chambers each of which communicates with the corresponding restrictor portion. In a lower surface of the damper plate 36, damper chambers 36*a*, 36*b*, 36*c*, 36*d* are formed at positions respectively corresponding to the common ink chambers. The damper chambers 36*a*-36*d* are open downward. Each damper chamber has the same horizontal cross-sectional shape as that of a lower portion of the corresponding common ink chamber which is adjacent to the damper plate 36.

The damper plate 36 is formed of an elastically deformable material such as a metal. The damper plate 36 has thin planar bottom plate portions 36*e* defining upper sides of the respective damper chambers. The bottom plate portions 36*e* can freely vibrate in upward and downward directions, namely, toward the common ink chambers and toward the damper chambers. When, upon ejection of the ink droplets, the pressure fluctuations generated in the pressure chambers are transferred to the common ink chambers, the bottom plate portions 36*e* are elastically deformed and vibrated. This deformation and vibration lead to absorption and reduction of the pressure fluctuations, that is, a damper effect is exhibited. As a result, this prevents a cross talk in which the pressure fluctuations generated in one of the pressure chambers are transferred to other pressure chambers.

Through holes for introducing the inks stored in the pressure chambers to the nozzles are formed through each plate 32-37 between the cavity plate 31 and the nozzle plate 38. The through holes are divided into groups in each of which the through holes vertically communicates with each other. That is, there are vertically formed through holes 32*f*-37*f* for introducing the black ink stored in the pressure chambers 31*e* to the nozzles 38*f*, through holes 32*h*-37*h* for introducing the yellow ink stored in the pressure chambers 31*f* to the nozzles 38*h*, through holes 32*i*-37*i* for introducing the cyan ink stored in the pressure chambers 31*g* to the nozzles 38*i*, and through holes 32*n*-37*n* for introducing the magenta ink stored in the pressure chambers 31*h* to the nozzles 38*n*. The through holes designated with the same alphabet vertically communicate with each other (32*f* to 37*f*/32*h* to 37*h*/32*i* to 37*i*/32*n* to 37*n*).

As shown in FIG. 4, ink supply holes 31*a*, 31*b*, 31*c*, 31*d* are formed in the cavity plate 31 for supplying the inks supplied from the buffer tank 90 (shown in FIG. 3) to the corresponding common ink chambers. Communication holes 32*a*, 32*b*, 32*c*, 32*d* and 33*a*, 33*b*, 33*c*, 33*d* are respectively formed in the base plate 32 and the supply plate 33 for communicating the ink supply holes 31*a*-31*d* with the corresponding common ink chambers. The ink supply holes 31*a*-31*d* of the cavity plate 31 are covered with a filter member 59 having filters 61, 62, 63, 64 for filtering out foreign substances contained in the respective inks.

Figure 7:
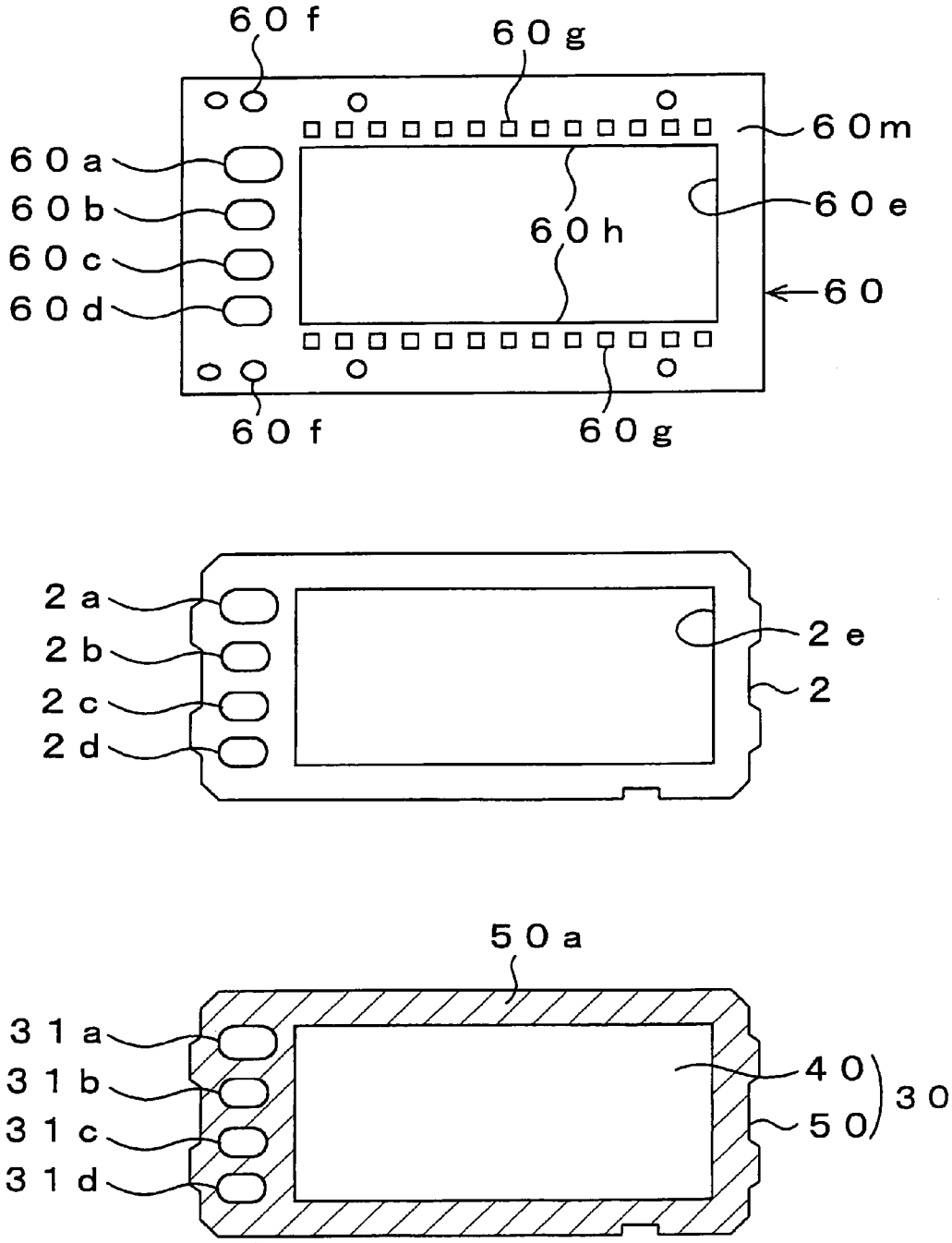
FIG. 7 is a plan view showing a reinforcing plate, an adhesive sheet, and the head unit.
Figure 8:
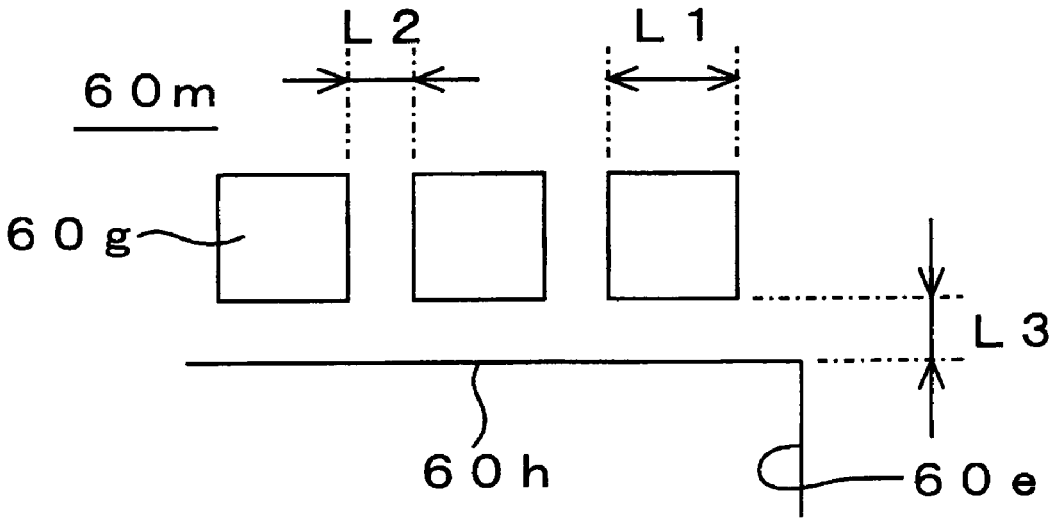
FIG. 8 is an explanatory view showing a portion of the reinforcing plate shown in FIG. 7 in enlargement.
Figure 9A:
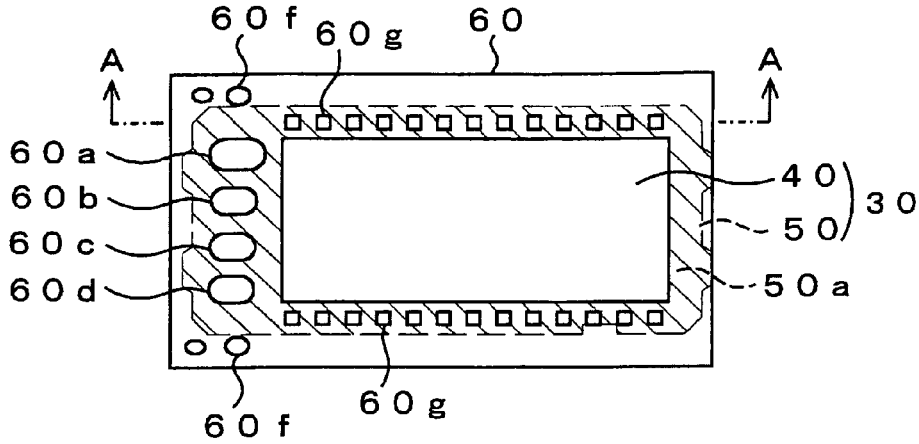
FIGS. 9A and 9B are explanatory views each showing a structure in which the head unit and the reinforcing plate are adhered to each other, that is.
Figure 9B:
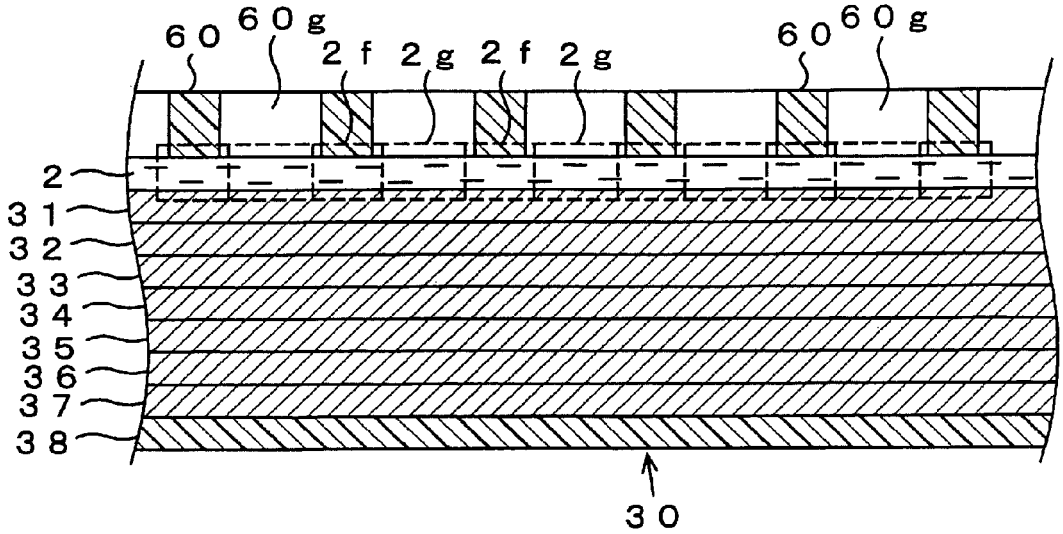

3. Adhesion Structure in which the Head Unit 30 and the Reinforcing Plate 60 are Adhered There will be next explained an adhesion structure in which the head unit 30 and the reinforcing plate 60 are adhered to each other, with reference to drawings. FIG. 7 is a plan view showing the reinforcing plate 60, an adhesive sheet 2, and the head unit 30. FIG. 8 is an explanatory view showing a portion of the reinforcing plate 60 shown in FIG. 7 in enlargement. FIGS. 9A and 9B are explanatory views each showing the adhesion structure in which the head unit 30 and the reinforcing plate 60 are adhered to each other. FIG. 9A is an explanatory view of the reinforcing plate 60 and the head unit 30 which are adhered and fixed to each other as seen from an upper side of the reinforcing plate 60. FIG. 9B is a cross-sectional view, in enlargement, showing the cross section taken along line A-A in FIG. 9A, with a portion of the cross section omitted.

As shown in FIG. 7, the reinforcing plate 60 has a frame portion 60*m* and an opening 60*e*. The frame portion 60*m* surrounds the opening 60*e* which accommodates the piezoelectric actuator 40, so that the reinforcing plate 60 has a generally frame shape. In the frame portion 60*m* and on opposite sides of the opening 60*e*, a plurality of recessed portions 60*g* opening at least toward the cavity unit 50 are formed. In this embodiment, each of the recessed portions 60*g* is provided by a through hole formed through the thickness of the frame portion 60*m*. The recessed portions 60*g* are formed along longitudinal edges 60*h* of the opening 60*e* which are opposed to each other. That is, the recessed portions 60*g* are formed along both longitudinal edges of the piezoelectric actuator 40 exposed from the opening 60*e*.

As shown in FIG. 8, the recessed portions 60*g* are arranged in rows at a distance L3 from the respective edges 60*h*, and equally spaced from each other at a distance L2. Each of the recessed portions 60*g* has an identical shape as seen in a direction perpendicular to the upper surface of the head unit 30. More specifically, each of the recessed portions 60*g* has a square shape with a side length L1. For instance, the length L1 is 1.0 mm, and the distances L2, L3 are 0.5 mm. Further, the reinforcing plate 60 is formed of a material (e.g., a metal material) having a higher rigidity than a material used to form the head unit 30.

As shown in FIG. 7, the piezoelectric actuator 40 is attached to a central portion of the upper surface of the cavity unit 50. A flat adhesion area 50*a* (indicated by hatching) for adhering the reinforcing plate 60 is continuously provided around the piezoelectric actuator 40 in the upper surface of the cavity unit 50. That is, the upper surface of the head unit 30 is provided by a peripheral portion of the upper surface of the cavity unit 50. The adhesive sheet 2 has a shape which coincides with that of the adhesion area 50*a*. Through holes 2*a*, 2*b*, 2*c*, 2*d* are formed through the adhesive sheet 2 at positions opposed to the respective ink supply holes 31*a*-31*d*. Each of the through holes 2*a*-2*d* has a shape which is the same as or slightly larger than a corresponding one of the ink supply holes 31*a*-31*d* of the head unit 30 and a corresponding one of ink supply holes 60*a*, 60*b*, 60*c*, 60*d* of the reinforcing plate 60. Further, the adhesive sheet 2 has an opening 2*e* for exposing the piezoelectric actuator 40. That is, the adhesive sheet 2 is continuously provided around the piezoelectric actuator 40 so as to surround the piezoelectric actuator 40. The adhesive sheet 2 also surrounds each of the ink supply holes. As a result, the adhesive sheet 2 exhibits a sealing effect in respective peripheries of the ink supply holes.

In a manufacturing step, the adhesive sheet 2 is positioned to the lower surface of the reinforcing plate 60, and then pressed and heated, whereby the adhesive sheet 2 is temporarily transferred to the reinforcing plate 60. Next, the ink supply holes 31*a*-31*d* of the head unit 30 and the corresponding ink supply holes 60*a*-60*d* of the reinforcing plate 60 are positioned to each other. Next, the reinforcing plate 60 is pressed to the head unit 30 with the adhesive sheet 2 interposed therebetween, and heated, so that the adhesive sheet 2 is melted. Then, the adhesive sheet 2 is cured by cooling, whereby the reinforcing plate 60 and the head unit 30 are adhered and fixed to each other. It is noted that, in view of the above, the lower surface of the reinforcing plate 60 may be referred to as an adhesion surface of the reinforcing plate 60, and the upper surface of the head unit 30 may be referred to as an adhesion surface of the head unit 30.

As shown in FIG. 9A, the adhesive sheet 2 is disposed so as to close lower opening ends of the respective recessed portions 60*g* of the reinforcing plate 60. As shown in FIG. 9B, there are formed first sections 2*f* which are equally spaced from each other and in each of which a part of the head unit 30 and a part of the reinforcing plate 60 are opposed and adhered to each other with a part of the adhesive sheet 2 interposed therebetween, and second sections 2*g* which are arranged along a straight line and in each of which a part of the head unit 30 is opposed to a space formed in a corresponding one of the recessed portions 60*g* and is not adhered to the reinforcing plate 60. It is noted that where a part of the adhesive sheet 2 contacts a part of only one of the adhesion surfaces of the head unit 30 and the reinforcing plate 60 like in this embodiment, the term "opposed to a space" means a state in which the part of the only one of the adhesion surfaces of the head unit 30 and the reinforcing plate 60 is adjacent to the space with the part of the adhesive sheet 2 interposed therebetween. The first sections 2*f* and the second sections 2*g* are alternately arranged at intervals along surfaces of the head unit 30 and the reinforcing plate 60 which are faced to each other. More specifically, the first sections 2*f* are equally spaced from each other. Likewise, the second sections 2*g* are equally spaced from each other.

Thus, in the head unit 30 to which the reinforcing plate 60 is adhered, the recessed portions 60*g* are arranged at regions of the reinforcing plate 60 which respectively extend along pair of longitudinal edges of the piezoelectric actuator 40. That is, the upper surface (i.e., the adhesion surface) of the head unit 30, the lower surface (i.e., the adhesion surface) of the reinforcing plate 60, and the adhesive sheet 2 constitutes an adhesion portion. The adhesion portion has special regions provided on either side of the piezoelectric actuator 40 and extending along the pair of longitudinal edges of the piezoelectric actuator 40. In each of the special regions, adhesion regions (i.e., the first sections 2*f*) and non-adhesion regions (i.e., the second sections 2*g*) are alternately arranged. In each of the adhesion regions, a part of the head unit 30 and a part of the reinforcing plate 60 are adhered to each other with a part of the adhesive sheet 2 interposed therebetween. On the other hand, in the non-adhesion regions, the head unit 30 and the reinforcing plate 60 are not adhered to each other. According to these constructions, a strength of adhesion of the reinforcing plate 60 and the head unit 30 is slightly reduced, so that vibrations generated in the piezoelectric actuator 40 can be absorbed by displacements of the adhesive and the cavity unit 50, leading to reduced cross talk.

In this embodiment, the adhesive sheet 2 is made of a thermoplastic material which exhibits a high corrosion resistance with respect to ink. The adhesive sheet 2 before cured is, for example, made of a material in which several kinds of adhesive components are added into a polypropylene resin or a polyethylene resin as a main component. After the head unit 30 and the reinforcing plate 60 are adhered to each other, the adhesive sheet 2 has, for example, a thickness of from 20 μm to 50 μm that can effectively reduce occurrences of the cross talk. According to an experiment having conducted by the inventor, resonance of the head unit 30 does not occur in this thickness of the adhesive sheet 2 upon driving of the piezoelectric actuator 40 in a predetermined cycle of the ink ejection.

4. Effects of the Embodiment (1) As described above, in the ink-jet recording apparatus 1 as the above-described embodiment, there are alternately arranged the first sections 2*f* in each of which the part of the head unit 30 and the part of the reinforcing plate 60 are adhered to each other with the part of the adhesive sheet 2 interposed therebetween, and the second sections 2*g*, namely, the non-adhesion regions, in each of which the part of the head unit 30 is opposed to the space formed in the corresponding recessed portion 60*g*. Thus, a strength of the adhesion of the reinforcing plate 60 and the head unit 30 can be slightly reduced. Consequently, the vibrations to be generated upon driving of the piezoelectric actuator 40 can be absorbed not only by the second sections 2*g* but also by the first sections 2*f*, leading to reduced cross talk among rows of the nozzles upon simultaneous ejections of the inks through different rows of the nozzles.

(2) In an upper surface of the cavity plate 31, the first sections 2*f* and the second sections 2*g* are formed between a region formed around the piezoelectric actuator 40 and the frame portion 60*m* of the reinforcing plate 60. Consequently, vibrations to be transferred to surroundings of the piezoelectric actuator 40 upon driving thereof can be efficiently absorbed by the first sections 2*f* and the second sections 2*g* which are formed in the surroundings. This leads to effective reduction of the cross talk.

(3) In particular, the first sections 2*f* and the second sections 2*g* are formed on both sides of the piezoelectric actuator 40, thereby absorbing, on the both sides of the piezoelectric actuator 40, the vibrations generated upon driving of the same 40. Thus, the cross talk can be effectively reduced.

(4) Further, the head unit 30 and the reinforcing plate 60 are adhered to each other with the adhesive sheet 2, leading to reduced operation time required for the adhesion of the head unit 30 and the reinforcing plate 60. In addition, the adhesive sheet 2 is softened and thinned by pressing and heating, during which distortions and the like in the flatness of the reinforcing plate 60 can be absorbed and corrected.

(5) The adhesive sheet 2 has a property of being deformed when pressurized and heated. Thus, a technique in which through holes are formed through the adhesive sheet 2 to form the second sections 2*g* tends to suffer from generation of error in positions and areas in which the second sections 2*g* are formed. However, the recessed portions 60*g* are formed in the reinforcing plate 60, thereby preventing the generation of the error.

(6) In particular, since the second sections 2*g* are respectively formed by the recessed portions 60*g*, respective areas of the second sections 2*g* are not reduced even if the adhesive sheet 2 is located on one of opposite sides of the second sections which is opposed to respective opening ends of the recessed portions 60*g*. Thus, the second sections 2*g* can be formed even if the adhesive sheet 2 is attached to an entire region of one of the adhesion surfaces of the head unit 30 and the reinforcing plate 60 which region coincides with the adhesion area 50*a* shown in FIG. 7. As a result, there is no need to control the regions, at a high accuracy, in which the adhesion layer is formed. This leads to reduced operation time in an adhesion step.

(7) The area of the adhesion of the head unit 30 and the reinforcing plate 60 can be changed by changing at least one of an area of the respective opening ends of the recessed portions 60*g* and a number of the recessed portions 60*g*, thereby adjusting a strength of the adhesion. In addition, a rigidity of a unit of the head unit 30 and the reinforcing plate 60 can be adjusted by changing at least one of the area of the respective opening ends of the recessed portions 60*g*, the number of the recessed portions 60*g*, and respective depths of the recessed portions 60*g*. Thus, even if the cross talk varies with specifications of the head unit 30, the cross talk can be reduced in each of the specifications by changing at least one of the area of the respective opening ends of the recessed portions 60*g*, the number of the recessed portions 60*g*, and the respective depths of the recessed portions 60*g*.

5. First Modification

Figure 10A:
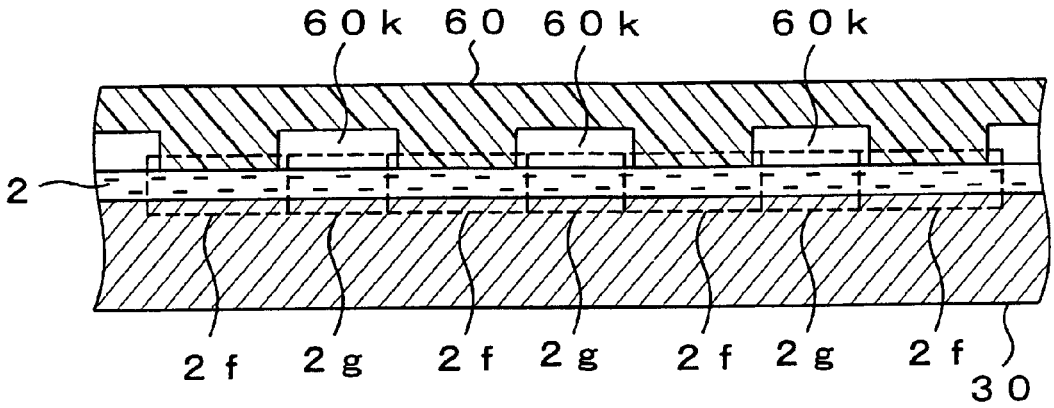
FIGS. 10A and 10B are cross-sectional views showing respective portions of cross sections of the reinforcing plate and the head unit in a first modification and a second modification, respectively, and corresponding to FIG. 9B.

FIG. 10A is a cross-sectional view showing a portion of a cross section of the reinforcing plate 60 and the head unit 30 and corresponding to FIG. 9B in the above-described embodiment. As shown in FIG. 10A, recessed portions 60*k* respectively provided by recesses opening only toward the head unit 30 are formed in the surface of the reinforcing plate 60 which is opposed to the surface of the head unit 30. The second sections 2*g* are formed by the respective recessed portions 60*k*. The recessed portions 60*k* can be formed by half-etching, laser working, or the like. It is noted that the recessed portions 60*k* may also be formed so as to open toward the reinforcing plate 60 in the surface of the head unit 30 which is opposed to the surface of the reinforcing plate 60, whereby the second sections 2*g* can also be defined. For instance, the recessed portions 60*k* opening toward the reinforcing plate 60 can be formed in the cavity plate 31. These constructions of the first modification can provide the same effects as those of the first embodiment. In view of the above-described embodiment and this first modificaton, the ink-jet recording apparatus 1 may be configured such that the adhesion surface of one of the head unit 30 and the reinforcing plate 60 has holes which are spaced from each other and which open in at least the adhesion surface of one of the head unit 30 and the reinforcing plate 60, whereby the first sections 2*f* and the second sections 2*g* are provided.

6. Second Modification

Figure 10B:
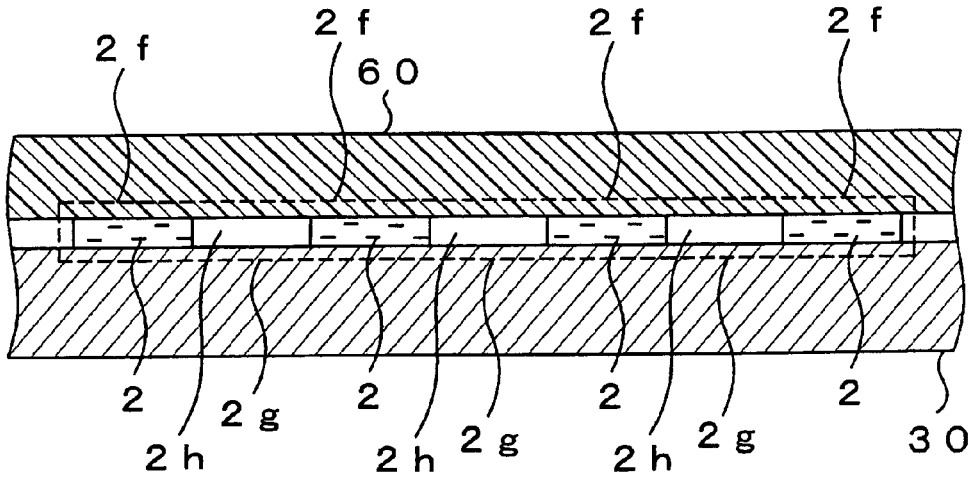

FIG. 10B is a cross-sectional view showing a portion of a cross section of the reinforcing plate 60 and the head unit 30 and corresponding to FIG. 9B in the above-described embodiment. As shown in FIG. 10B, a plurality of through holes 2*h* are formed through the adhesive sheet 2. In other words, the adhesive sheet 2 is configured such that a plurality of parts thereof are spaced from each other in the special region, whereby the plurality of first sections 2*f* and the plurality of second sections 2*g* are provided. More specifically, there are alternately arranged, between the reinforcing plate 60 and the head unit 30, the first sections 2*f* each including the adhesive sheet 2, and the second sections 2*g* in each of which a part of the head unit 30 and a part of the reinforcing plate 60 are opposed to a space. It is noted that where a part of at least one of the adhesion surfaces of the head unit 30 and the reinforcing plate 60 does not contact a part of the adhesive sheet 2 like in this second modification, the term "opposed to a space" means a state in which the part of the at least one of the adhesion surfaces of the head unit 30 and the reinforcing plate 60 is adjacent to the space. The construction of this second modification can also provide the same effects as those of the above-described embodiment.

7. Other Embodiments (1) The recessed portions 60*g*, 60*k* of the reinforcing plate 60 can be formed in a plurality of rows on either side of the pair of longitudinal edges of the piezoelectric actuator 40. The recessed portions 60*g*, 60*k* in each of the rows may be formed at positions that are the same, in a direction perpendicular to the longitudinal direction of the piezoelectric actuator 40, as positions of the recessed portions 60*g*, 60*k* in other rows. Further, the recessed portions 60*g*, 60*k* may also be formed in a zigzag fashion. Each of the recessed portions 60*g*, 60*k* may not have an identical area or shape. That is, each of the recessed portions 60*g*, 60*k* may be determined in shape, area, number, and position such that the cross talk can be most effectively reduced.

(2) The above-described embodiments and modifications relate to the ink-jet recording apparatus as an example of the droplet ejecting apparatus of the present invention. However, it should be understood that the present invention may be applied to a droplet ejecting apparatus which ejects a liquid different from ink. (3) Further, the present invention may be applied to an ink-jet recording apparatus in which a single sort or color of ink is ejected to perform a recording operation. (4) Furthermore, the present invention can also be applied to a head unit which ejects liquid droplets (e.g., ink droplets) using a pressure fluctuation caused by air bubbles generated in the liquid, owing to heat energy given to the liquid, or using a displacement of a vibration plate caused by static electricity.

What is claimed is:

1. A droplet ejecting apparatus, comprising:

a head unit having a generally planar shape and including a plurality of nozzles through which droplets are ejected, a holder which holds the head unit, a reinforcing plate via which the head unit is held by the holder and which has an adhesion surface as at least a part of one of opposite surfaces thereof to which an adhesion surface of the head unit as at least a part of one of opposite surfaces thereof is adhered with an adhesive layer interposed between the adhesion surface of the reinforcing plate and the adhesion surface of the head unit, and an adhesion portion constituted by the adhesion surface of the head unit, the adhesion surface of the reinforcing plate, and the adhesive layer;

wherein the adhesion portion has a special region in which (a) a plurality of first sections in each of which a part of the adhesion surface of the head unit and a part of the adhesion surface of the reinforcing plate are opposed to each other with a part of the adhesive layer interposed therebetween and are adhered to each other and (b) a plurality of second sections in each of which a part of the adhesion surface of one of the head unit and the reinforcing plate is opposed to a space and is not adhered to the adhesion surface of the other of the head unit and the reinforcing plate are alternately arranged;

wherein the head unit includes (A) a cavity unit which has a generally planar shape, which has the plurality of nozzles in one of opposite surfaces thereof, and in which a plurality of liquid flow channels corresponding to the plurality of nozzles are formed and (B) an actuator which is attached to a part of the other of opposite surfaces of the cavity unit and which operates for ejecting the droplets through the plurality of nozzles;

wherein the adhesion surface of the head unit is provided by a different part of the other of opposite surfaces of the cavity unit than said part thereof;

wherein the actuator is attached to a central portion of the other of opposite surfaces of the cavity unit, and the adhesion surface of the head unit is provided by a peripheral portion of the other of opposite surfaces of the cavity unit;

wherein the reinforcing plate includes an opening in which the actuator is provided, so as to have a generally frame shape; and wherein the special region is provided only near the actuator.

2. The droplet ejecting apparatus according to claim 1;

wherein the plurality of second sections are arranged along a straight line.

3. The droplet ejecting apparatus according to claim 1;

wherein the plurality of second sections have an identical shape as seen in a direction perpendicular to the adhesion surface of the head unit.

4. The droplet ejecting apparatus according to claim 1;

wherein the plurality of first sections are equally spaced from each other.

5. The droplet ejecting apparatus according to claim 1;

wherein the plurality of second sections are equally spaced from each other.

6. The droplet ejecting apparatus according to claim 1;

wherein the reinforcing plate is formed of a material having a higher rigidity than a material used to form the head unit.

7. The droplet ejecting apparatus according to claim 1;

wherein the adhesive layer is configured such that a plurality of parts thereof are spaced from each other in the special region, whereby the plurality of first sections and the plurality of second sections are provided.

8. The droplet ejecting apparatus according to claim 1;

wherein the adhesion surface of the other of the head unit and the reinforcing plate has a plurality of holes which are spaced from each other and which open in at least the adhesion surface of the other of the head unit and the reinforcing plate, whereby the plurality of first sections and the plurality of second sections are provided.

9. The droplet ejecting apparatus according to claim 8;

wherein each of the plurality of holes is provided by a through hole formed through a thickness of the reinforcing plate.

10. The droplet ejecting apparatus according to claim 8;

wherein each of the plurality of holes is provided by a recess provided in the other of the head unit and the reinforcing plate.

11. The droplet ejecting apparatus according to claim 1;

wherein the special region extends along an edge of the actuator.

12. The droplet ejecting apparatus according to claim 1;

wherein the adhesion portion of the head unit and the reinforcing plate is continuously provided around the actuator.

13. The droplet ejecting apparatus according to claim 1;

wherein a plurality of special regions each as the special region are provided, and wherein the plurality of special regions are provided on either side of the actuator.

14. The droplet ejecting apparatus according to claim 13;

wherein the actuator has a rectangular planar shape, and wherein the plurality of special regions are provided along a pair of longitudinal edges of the actuator, respectively.

15. The droplet ejecting apparatus according to claim 1;

wherein the cavity unit is formed by stacking a plurality of plates including (i) a nozzle plate which has a surface as the one of opposite surfaces of the cavity unit and (ii) a pressure-chamber-defining plate which has a surface as the other of opposite surfaces of the cavity unit and which defines a plurality of pressure chambers that store a liquid to be ejected through the respective nozzles; and wherein the actuator is configured to apply a pressure, for ejecting the droplets, to the liquid that is stored in the respective pressure chambers.

16. The droplet ejecting apparatus according to claim 1;

wherein the adhesive layer is formed of an adhesive sheet.

17. The droplet ejecting apparatus according to claim 1;

wherein the adhesive layer has a thickness of from 20 μm to 50 μm.

18. The droplet ejecting apparatus according to claim 8;

wherein the other of the head unit and the reinforcing plate is the reinforcing plate in which the plurality of holes are formed.

19. The droplet ejecting apparatus according to claim 8;

wherein each of the plurality of holes is covered by the adhesive layer in a direction in which the adhesive layer is interposed between the reinforcing plate and the head unit.

20. The droplet ejecting apparatus according to claim 8;

wherein a distance between each of the plurality of holes and an edge of the actuator is shorter than a length of each of the plurality of holes in a direction along the edge of the actuator.

21. The droplet ejecting apparatus according to claim 8, wherein the reinforcing plate has at least one through hole which is different from the plurality of holes and through which a liquid flows.

22. The droplet ejecting apparatus according to claim 10;

wherein the recess is formed by a blind hole.

23. The droplet ejecting apparatus according to claim 1;

wherein the plurality of nozzles form at least one nozzle row;

wherein the special region extends in a direction in which the at least one nozzle row extends; and wherein the plurality of first sections and the plurality of second sections are alternately arranged in the direction in which the special region extends.

24. The droplet ejecting apparatus according to claim 23;

wherein the at least one nozzle row is a plurality of the nozzle rows each including corresponding ones of the plurality of nozzles;

wherein the special regions are provided only on opposite sides of the actuator in a direction perpendicular to the direction in which the at least one nozzle row extends.

25. The droplet ejecting apparatus according to claim 24;

wherein the plurality of nozzles of each of the plurality of nozzle rows are arranged in a longitudinal direction of the actuator.

* * * * *